US008952827B2

(12) United States Patent
Zhang et al.

(10) Patent No.: US 8,952,827 B2
(45) Date of Patent: Feb. 10, 2015

(54) ALARM FOR A CASING OF DEVICE WITH A SLIDING COVER

(71) Applicant: ScienBiziP Consulting (Shen Zhen) Co., Ltd., Shenzhen (CN)

(72) Inventors: De-Guang Zhang, Shenzhen (CN); Fang-Li Pan, Shenzhen (CN); Ai-Yu Pan, Shenzhen (CN)

(73) Assignee: ScienBiziP Consulting(Shenzhen)Co.,Ltd., Guangdong (CN)

( * ) Notice: Subject to any disclaimer, the term of this patent is extended or adjusted under 35 U.S.C. 154(b) by 0 days.

(21) Appl. No.: 13/873,169

(22) Filed: Apr. 29, 2013

(65) Prior Publication Data

US 2014/0306830 A1 Oct. 16, 2014

(30) Foreign Application Priority Data

Apr. 10, 2013 (CN) ..... 2013 1 0122529

(51) Int. Cl.
*G08B 21/00* (2006.01)
*G08B 21/18* (2006.01)

(52) U.S. Cl.
CPC ..... *G08B 21/18* (2013.01)
USPC ..... 340/686.1; 340/568.1

(58) Field of Classification Search
USPC ..... 340/568.1, 569, 570, 686.1; 200/61.61, 200/61.71, 61.74, 61.76, 327; 220/345.1, 220/345.2, 345.3; 206/459.1
See application file for complete search history.

(56) References Cited

U.S. PATENT DOCUMENTS 4,688,023 A * 8/1987 McGill et al. ..... 340/545.6

* cited by examiner

*Primary Examiner* — Jeffery Hofsass
(74) *Attorney, Agent, or Firm* — Novak Druce Connolly Bove + Quigg LLP

(57) ABSTRACT

A casing includes a base, a trigger switch, an alarm device, and a cover. The base includes a first side plate and a second side plate perpendicular to the first side plate. The trigger switch is mounted to an inner side of the first side plate. A resilient tab is formed on a top of the trigger switch. The alarm device is electrically connected to the trigger switch. The cover covers on a top of the base and deforms the resilient tab down. A recess is defined in a bottom surface of the cover and located between the second side plate and the resilient tab. When the cover is slid away from the second side plate, the recess aligns with the resilient tab. The resilient tab enters the recess and restores. The trigger switch triggers the alarm device to alarm.

4 Claims, 3 Drawing Sheets

ALARM FOR A CASING OF DEVICE WITH A SLIDING COVER

BACKGROUND

1. Technical Field

The present disclosure relates to a casing of an electronic device.

2. Description of Related Art

Some devices are equipped with an alarm to their casings to prevent the casings from being opened by non-professional users. The casing is mounted with an alarm device, and a trigger switch to trigger the alarm device. When a cover is covered on the casing, the cover deforms a resilient tab of the trigger switch down. The alarm device is not triggered. When the casing needs to be opened, the cover is first slid horizontally, and then moved up. The resilient tab of the trigger switch is restored and triggers the alarm device to alarm the authorized user. However, if an object is inserted into the casing to push down the resilient tab before the cover is moved up, the alarm device will not alarm after the cover is moved away. Therefore, a casing with such a conventional structure is not safe.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
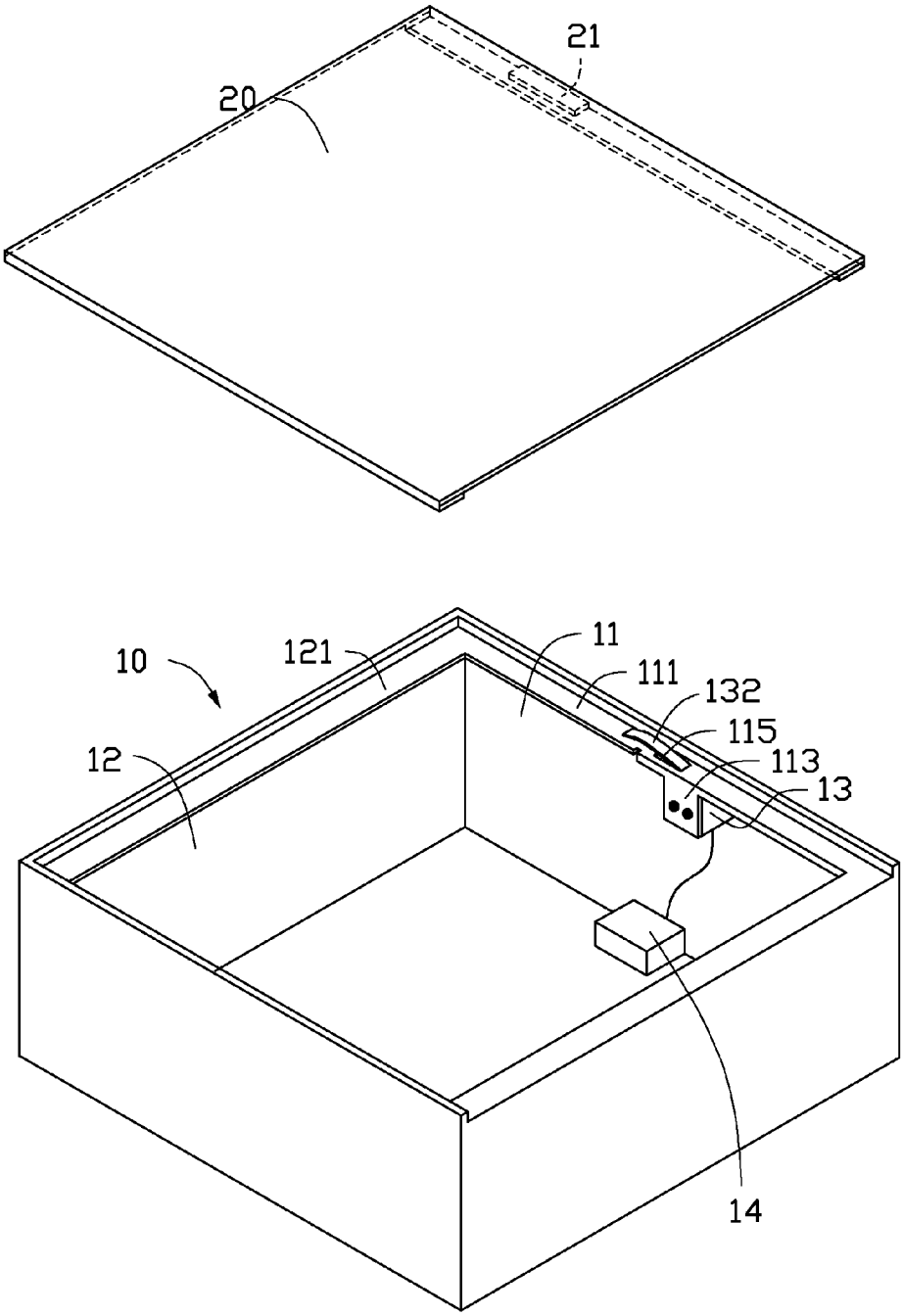
FIG. 1 is an exploded, isometric view of an embodiment of a casing.
Figure 2:
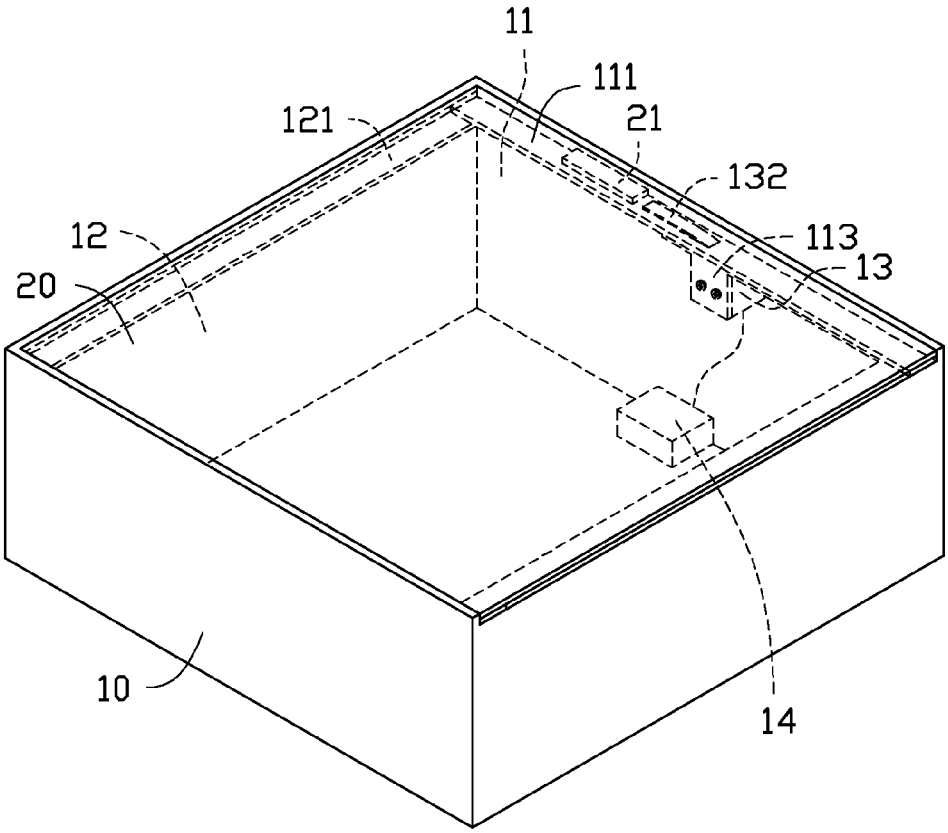
FIG. 2 is an assembled, isometric view of FIG. 1.

FIGS. 1 and 2 show an exemplary embodiment of a casing. The casing includes a base 10, a trigger switch 13, an alarm device 14, and a cover 20.

The base 10 includes a first side plate 11, and a second side plate 12 perpendicularly connected to the first side plate 11. A supporting plate 111 perpendicularly extends from an upper portion of an inner side of the first side plate 11. A supporting plate 121 perpendicularly extends from an upper portion of an inner side of the second side plate 12. The supporting plate 111 and the supporting plate 121 are coplanar. A mounting tab 113 extends down from a side of the supporting plate 111 away from the first side plate 11. An opening 115 is defined in the supporting plate 111, near the mounting tab 113.

The trigger switch 13 is screwed to a side of the mounting tab 113 facing the first side plate 11. A resilient tab 132 is formed on a top of the trigger switch 13. The resilient tab 132 extends through the opening 115 and beyond a top of the supporting plate 111.

The alarm device 14 is mounted in the base 10 and is electrically connected to the trigger switch 13. In the embodiment, the alarm device 14 is a buzzer.

A recess 21 is defined in a side of a bottom surface of the cover 20. The cover 20 is supported on the supporting plates 111 and 112, to cover a top of the base 10. The cover 10 abuts against the resilient tab 132 and deforms the resilient tab 132 down. The recess 21 faces the supporting plate 111 and is located between the second side plate 12 and the resilient tab 132.

Figure 3:
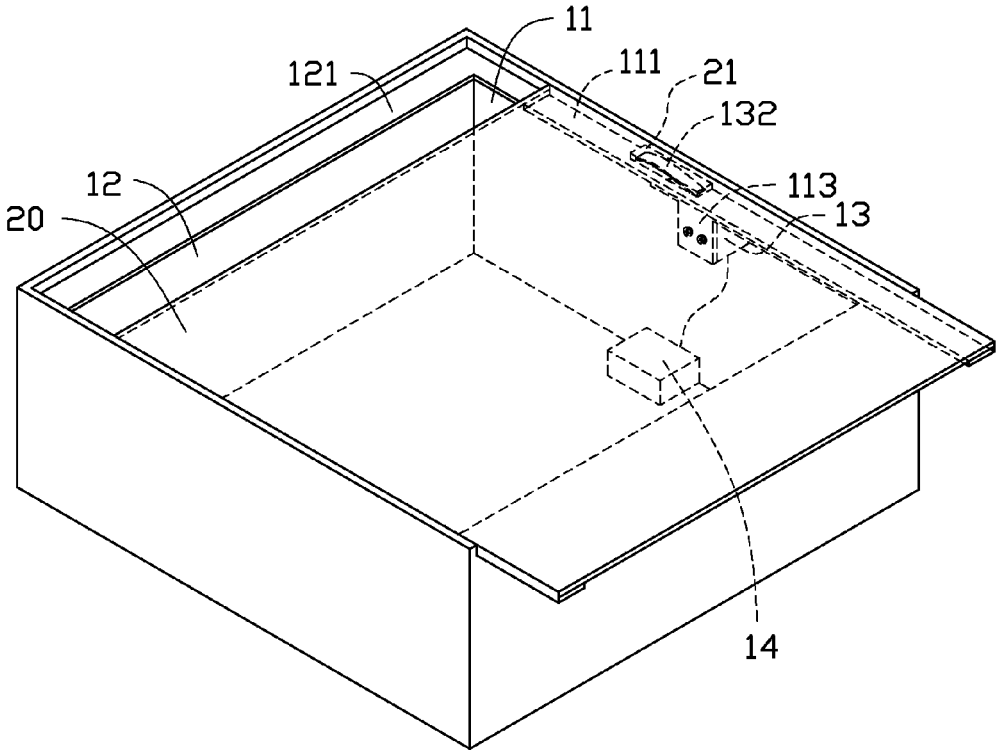
FIG. 3 is similar to FIG. 2, but showing another state.

Referring to FIG. 3, to open the casing, the cover 20 is slid along the supporting plate 111 away from the second side plate 12. The recess 21 moves and aligns with the resilient tab 132. The resilient tab 132 enters the recess 21 and is restored. The trigger switch 13 triggers the alarm device 14 to buzz to alarm the authorized user.

Even though numerous characteristics and advantages of the embodiments have been set forth in the foregoing description, together with details of the structure and the functions of the embodiments, the disclosure is illustrative only, and changes may be made in details, especially in the matters of shape, size, and arrangement of parts within the principles of the embodiments to the full extent indicated by the broad general meaning of the terms in which the appended claims are expressed.

What is claimed is:

1. A casing, comprising:

a base comprising a first side plate and a second side plate perpendicular to the first side plate;

a trigger switch mounted to an inner side of the first side plate, a resilient tab formed on a top of the trigger switch;

an alarm device electrically connected to the trigger switch; and a cover covering a top of the base and deforming the resilient tab down, a recess defined in a bottom surface of the cover and located between the second side plate and the resilient tab;

wherein when the cover is slid away from the second side plate, the recess moves to align with the resilient tab, the resilient tab enters the recess and restores and causes the trigger switch to trigger the alarm device to alarm.

2. The casing of claim 1, wherein the alarm device is a buzzer.

3. The casing of claim 1, wherein a first supporting plate perpendicularly extends from an upper portion of the inner side of the first side plate, a second supporting plate perpendicularly extends from an upper portion of an inner side of the second side plate, the cover is supported on the first supporting plate and second supporting plate.

4. The casing of claim 3, wherein a mounting tab extends down from the first supporting plate, the trigger switch is fastened to an inner side of the mounting tab, an opening is defined in the first supporting plate and is near the mounting tab, the resilient tab extends through the opening.

* * * * *